United States Patent [19]

Hermann et al.

[11] 4,388,777

[45] Jun. 21, 1983

[54] TOY SAILPLANE

[76] Inventors: Carl Z. Hermann, Sugar Hill Rd., Falls Village, Conn. 06031; Timothy L. Locke, Lower River Rd., West Cornwall, Conn. 06796

[21] Appl. No.: 296,159

[22] Filed: Aug. 25, 1981

[51] Int. Cl.[3] ..... A63H 27/00

[52] U.S. Cl. ..... 46/79; 244/35 R

[58] Field of Search ..... 46/79, 78, 80, 81, 76 R, 46/76 A, 77, 74 R; 244/16, 13, 154, 35 R; D21/87-90; 273/426, 428

[56] References Cited

U.S. PATENT DOCUMENTS

| | | | |
|---|---|---|---|
| D. 149,666 | 5/1948 | Northrop et al. | D21/87 X |
| D. 257,634 | 12/1980 | Miller et al. | D21/89 X |
| 1,924,651 | 8/1933 | Richter | 244/35 R |
| 2,441,758 | 5/1948 | Garbell | 244/35 R |
| 2,784,524 | 3/1957 | Jackle | 46/79 |
| 4,068,810 | 1/1978 | Malewicki | 244/16 X |

OTHER PUBLICATIONS

*American Modeler,* Apr. 1958, p. 11, Sketchbook.

*Aviation Dictionary and Reference Guide,* 3rd Ed. 1951, p. 239 Aero, Pub., Inc., L.A., Cal. "Washin" and "Washout".

*Primary Examiner*—Mickey Yu

*Attorney, Agent, or Firm*—Fitzpatrick, Cella, Harper & Scinto

[57] ABSTRACT

A toy sailplane having a single piece sweptback wing that is symmetrical with respect to a central plane is disclosed. The wing has a central nose and two leading edges extending in obtuse angular relation from the nose. The wing includes a wing tip portion located at the end of each leading edge that is upwardly directed to provide flight stability. The wing also includes a trailing edge extending between the tip portions. A weight is suspended from the wing at a location on the central plane intermediate the nose and the trailing edge, the weight preferably being longitudinally adjustable to vary the center of gravity of the sailplane and the angle of attack of the wing.

25 Claims, 10 Drawing Figures

Fig. 1.
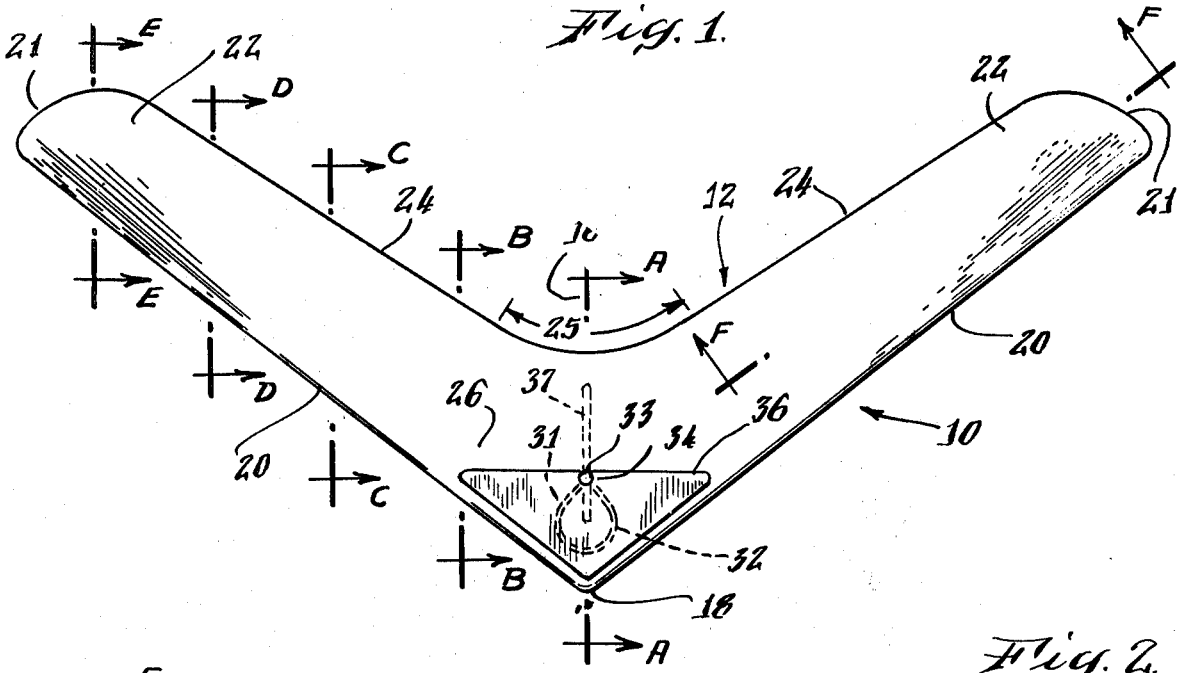
Fig. 2.
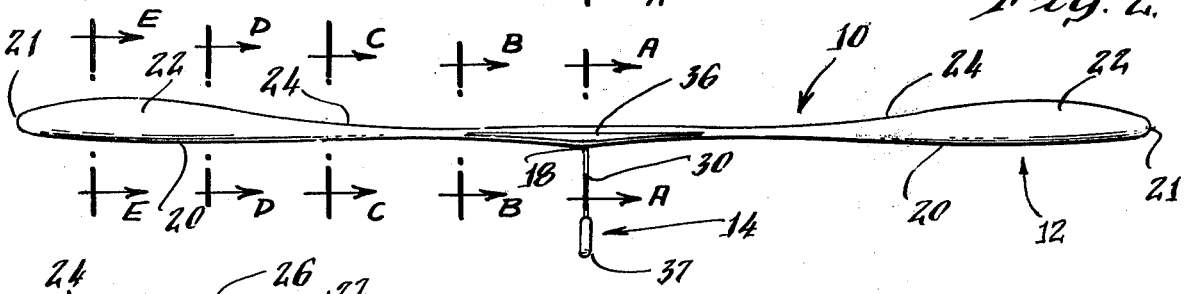
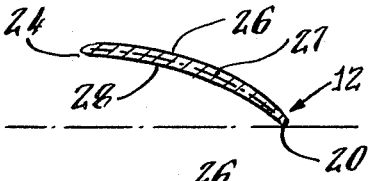
Fig. 1E
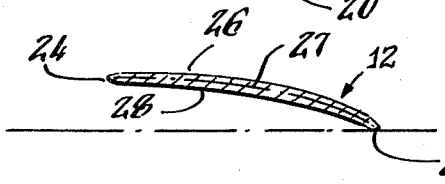
Fig. 1D
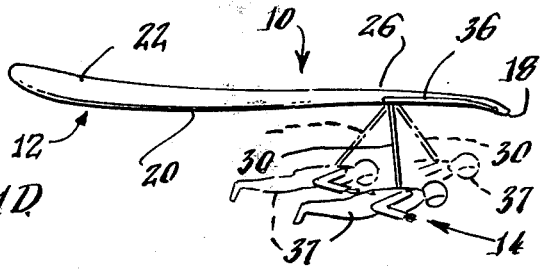
Fig. 3
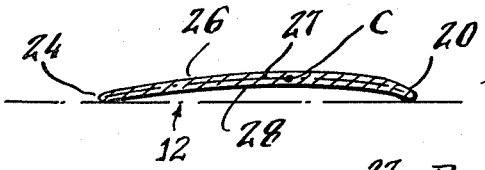
Fig. 1C.
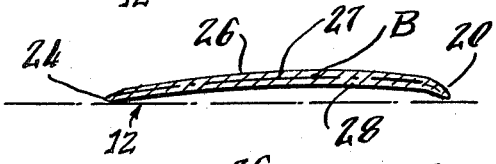
Fig. 1B.
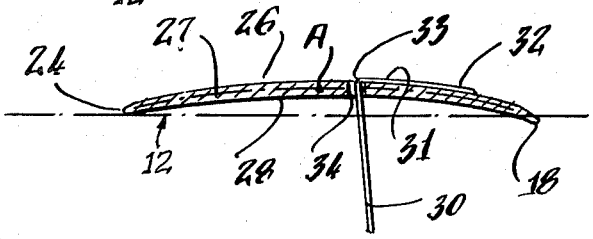
Fig. 1A.

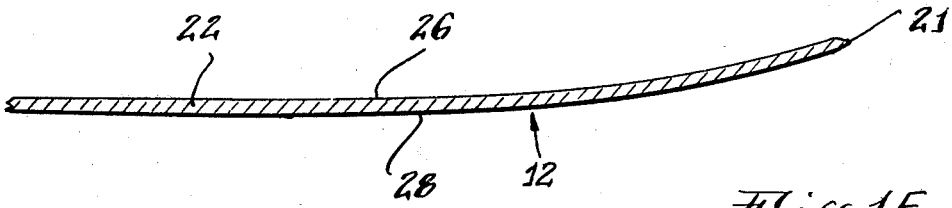
Fig. 1F.
Fig. 4.
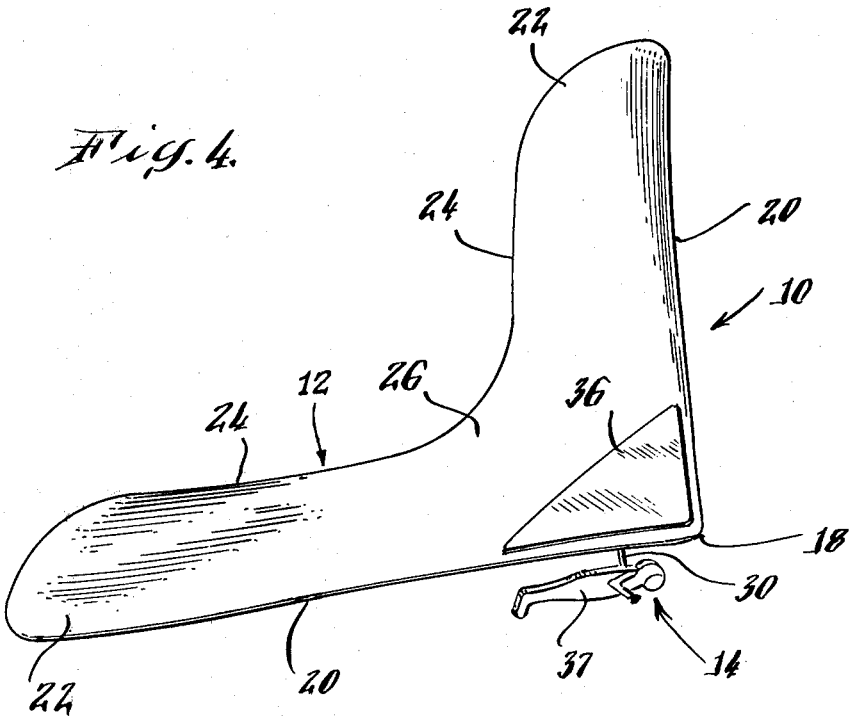

TOY SAILPLANE

BACKGROUND OF THE INVENTION

1. Field of the Invention

The present invention relates to unpowered vehicles, and, more particularly the present invention relates to a toy sailplane that will intermittently soar and glide for an extended time period.

2. Description of the Prior Art

Many prior art gliders, particularly toys, simulate commercial aircraft in that they comprise a fuselage, two wings that provide lift and a vertical tail that provides lateral stabilization. An example of one type of toy glider is one in which the wings and fuselage are separate pieces, made of balsa wood or polystyrene foam, which must be assembled accurately so that the resulting glider is aerodynamically balanced. The wings of this type of glider are often knocked out of alignment upon landing and then must be realigned prior to the next flight. Moreover, the flight of this type of glider is characterized by a relatively short flight period wherein the glider flies in a smooth generally linear path without substantial upward soaring.

Another toy glider, disclosed in U.S. Pat. No. 4,195,439, comprises a single wing that has a generally rectangular shape, the wing being weighted at the center of the leading edge. The front area of the wing comprises a convexo-concave portion that is said to impart lift to the wing while the rear area of the wing is a concavo-convex portion that is said to impart drag on the wing. The wing does not include a vertical tail structure or other structure that provides lateral stability. Thus, it is believed that this glider would have little or no directional stability.

Another toy glider, disclosed in U.S. Pat. No. 3,898,763, includes a fuselage portion and a delta shaped wing configuration. The delta wing includes a shallow reflex at its trailing edge to provide drag.

Other toy gliders are disclosed in the following patents: U.S. Pat. No. 3,246,425; U.S. Pat. No. 3,576,086; U.S. Pat. No. 3,898,765; U.S. Pat. No. Des. 53,902; U.S. Pat. No. Des. 170,025; U.S. Pat. No. Des. 198,038; U.S. Pat. No. Des. 232,650; U.S. Pat. No. Des. 240,437; U.S. Pat. No. Des. 240,438; U.S. Pat. No. Des. 240,439; U.S. Pat. No. Des. 240,440; U.S. Pat. No. Des. 240,441.

SUMMARY OF THE INVENTION

The sailplane in general accordance with the present invention comprises a single piece sweptback wing that is substantially symmetrical about a central plane and further comprises a weight that is suspended from the wing. The wing has a central nose and two leading edges extending in an obtuse angular relation from the central nose. The wing includes tip portions that are located at respective ends of the leading edge and that are directed upwardly to provide flight stability. The wing also includes a trailing edge extending between the tip portions. Generally continuous and smooth upper and lower surfaces extend between the leading and trailing edges of the wing.

The upwardly directed wing tips, also referred to as "wash out" act to impart a downward force behind the aerodynamic center which tends to maintain the wing at a desired angle of attack. In a dive, the upwardly directed wing tips rotate the wing so it comes out of the dive. When the wing is in a stall, that is, the angle of attack is large, the upturned wing tips as well as the suspended weight rotate the wing out of a stall condition.

The upwardly directed wing tips also provide for lateral stability, that is, they enable the wing to resist rolling to either side. For example, if the wing rolls to one side wherein one wing tip is lower than the other, air spills off the upper wing and the lower wing encounters a lift force thereby restoring the wing to level flight.

In accordance with one aspect of the invention, mean chords of the wing taken at cross-sections parallel to and progressing outwardly from the central plane have average slopes that gradually increase to define upwardly directed wing tip portions that provide directional and lateral stability as well as laterally balanced drag. It is believed that since the upwardly directed wing tip portions provide drag in regions of the wing spaced symmetrically from the central plane, the wing will continually adjust its lateral direction to provide an equilibrium of drag forces on the symmetrically spaced wing tip portions. Thus, lateral stabilization of the wing is provided without the use of a central vertical stabilizer. For example, when the wing, in flight, encounters a cross-wind, a disequilibrium in drag forces between the tip portions occurs and the wing has a tendency to turn into the wind in order to reach an equilibrium of drag forces on the spaced apart wing tip portions. When the wing has a tail wind, that is a wind from the rear, the upwardly directed tip portions tend to direct the sailplane in the direction of the wind. Thus, when the sailplane is flown, there will be periods when the sailplane is a tail wind will rapidly glide forwardly and slightly downwardly until there is a change of wind at which time the plane will turn into the wind and soar upwardly. This intermittent soaring and gliding makes the sailplane in general accordance with the invention interesting and amusing to watch. Further, this sailplane will fly for an extended time period.

The sailplane of the invention also includes a weight suspended from the wing at a location on the central plane intermediate the nose and the trailing edge. In accordance with one aspect of the invention, the weight is suspended from the wing by a strut that is attached to the wing at approximately its aerodynamic center, that is, the point about which the drag and lift force moments exerted on the wing are substantially resolved and the net moment on the wing is substantially constant for all angles of attack. In accordance with another aspect of the invention, the weight is longitudinally adjustable to provide for adjustment of the center of gravity of the sailplane and for adjustment of the angle of attack of the wing. The longitudinal adjustment in accordance with the invention, is provided by suspending the weight from the wing by a bendable strut, such as, for example a metal wire. Thus, a person seeking to adjust the longitudinal location of the weight, simply bends the wire to locate the weight at a desired position relative to the wing. In high speed wind conditions, the weight is adjustable forwardly to provide a low angle of attack whereas in low speed wind conditions, the weight is adjustable rearwardly to provide a large angle of attack.

In accordance with another aspect of the invention, the mean chords of the wing taken at cross-sections parallel to and progressing outwardly from the central plane of the wing each have a convex shape having no more than one inflection point. This wing shape is unlike prior art toy gliders having a wing that has a convexo-concave portion near its leading edge and a concavo-convex portion near its trailing edge wherein each of these portions has an inflection point. In accordance with another aspect of the invention, the mean chords, as they progress outwardly, gradually change from chords in the central area of the wing having a single inflection point to chords in the tip portions of the wing having only a positive slope. Thus, the central area of the wing has downwardly directed leading and trailing edges and the tip portions of the wing has a downwardly directed leading edge and an upwardly directed trailing edge. During flight of the sailplane, the central area of the wing provides the necessary lift while the tip portions, which are upwardly directed, provide the necessary directional and lateral flight stability.

Flight of the sailplane in accordance with the present invention is characterized by smooth stable gliding from a high point to a lower point with smooth stable soaring flight when the vertical component of the wind flowing over the wing exceeds the rate of descent, or sinking speed, of the sailplane. The sailplane in accordance with the invention soars upwardly on rising convection currents, which are almost always present to some degree in the atmosphere. Thus, the flight of a toy sailplane in accordance with the present invention is characterized by intermittent periods of gliding and soaring and is entertaining and amusing.

The sailplane in accordance with the present invention is particularly easy and inexpensive to manufacture since its wing is formed in a single piece and preferably formed by molding polystyrene foam. The location of the weight, which depends from the wing, can be adjusted for various wind conditions thus making the sailplane suitable for flying on calm as well as windy days.

Additional advantages of the sailplane in accordance with the present invention will be described in the detailed description of the invention with reference to the drawings which follows.

BRIEF DESCRIPTION OF THE DRAWINGS

FIG. 1 is a top plan view of a sailplane in accordance with the present invention;

FIGS. 1A, 1B, 1C, 1D and 1E are respectively vertical cross-sectional views of the wing taken respectively on planes A—A, B—B, C—C, D—D, E—E of FIGS. 1 and 2;

FIG. 1F is a vertical cross-sectional view of a portion of one-half of the wing taken on plane F—F of FIG. 1;

FIG. 2 is a front plan view of the sailplane shown in FIG. 1;

FIG. 3 is a side plan view of the sailplane shown in FIGS. 1 and 2; and FIG. 4 is a perspective view of the sailplane shown in FIGS. 1 through 3.

DETAILED DESCRIPTION OF THE INVENTION

Referring to FIGS. 1 through 4, a sailplane 10 in accordance with the present invention is shown. Sailplane 10 comprises a single piece sweptback wing 12 and a weight 14 that is suspended from the wing. The configuration of the wing 12 will be described immediately below and the weight 14 will be described in detail thereafter.

The single piece sweptback wing 10 is substantially symmetrical about a central vertical plane 16 which is the plane A—A shown in FIGS. 1 and 2. The wing includes a central nose 18 and two leading edges 20 extending in an obtuse angular relation from the nose 18. The leading edges 20 preferably extend with respect to each other at an angle of between about 80 and about 165 degrees, and most preferably at an angle of between about 90 and 120 degrees. The wing 10 has tip portions 22 each of which is located at one respective end of the leading edges, and has a trailing edge 24 that extends between tip portions 22. For each wing tip portion 22, the trailing edge 24 curves smoothly rearwardly and inwardly from leading edge 20 to provide rounded wing tips 21 that minimize turbulence of air flowing past wing tip portions 22.

As shown in FIG. 2, a central nose 18 is directed downwardly. The trailing edge 24 in the region between wing tip portions 22 and the central plane 16 is directed inwardly and forwardly toward said central plane and includes a central segment 25 that curves smoothly and concavely in the region of the central plane 16 thereby providing a sweptback wing, which has distinct right and left wing sections.

As can be seen particularly well in FIGS. 1A through 1F as well as FIG. 4, wing 12 has a generally continuous smooth upper surface 26 and a generally continuous smooth lower surface 28 both of which extend between the leading edges 20 and the trailing edge 24. The wing is preferably a "flat" wing, that is, one having a substantially uniform thickness throughout except in the region of the leading and trailing edges wherein the upper surface tapers smoothly downwardly to the lower surface 28 to provide a smooth transition between the upper and lower surfaces.

The views shown in FIGS. 1A through 1E are taken on vertical cross-sectional planes parallel to and progressing outwardly from the central plane 16 which corresponds to the plane A—A. The mean chords 27, that is, lines midway between the upper surface 26 and lower surface 28 of the wing, for each cross-sectional view have average slopes that gradually increase as the chords progress outwardly to provide upwardly directed wing tip portions as can be best shown in FIGS. 1D and 1E. By "average slope" it is meant the ratio of the vertical to the horizontal difference in distance between the leading edge 20 and the trailing edge 24.

In one embodiment of the sailplane in accordance with the present invention, the chords 27 as they progress outwardly from the central plane 16 gradually change from chords having inflection points that provide a wing having downwardly directed leading and trailing edges to chords having only a positive slope that provide a wing having an upwardly directed trailing edge in a region of the tip portions of the wing. More particularly, as can be seen in FIGS. 1A, 1B and 1C, the mean chords 27 have respectively reflection points A, B and C whereas chords 27 of the cross-section shown in FIGS. 1D and 1E have only a positive slope.

Referring in particular to FIGS. 2 and 3, the sailplane in accordance with the present invention further includes a weight 14 (a simulated hang glider pilot as shown in the FIGURES) that is suspended from the wing and that has its center of gravity positioned coincident with the central plane 16 of the wing. Weight 14 is preferably molded from a hard plastic and may resemble various identifiable shapes, such as for example, the shape of a hang-glider pilot as shown in FIGS. 3 and 4. However, the weight 14 may be shaped to simulate various objects. It is preferable that the plan area 37 (see FIG. 2) of the front of weight 14 be minimized to reduce drag and thus, the weight should be relatively thin. In a preferred embodiment of the invention, the weight 14 is attached to one end of a support strut 30 that extends downwardly from the wing. The strut 30 comprises a wire that is bendable to adjust the location of the weight 14. The wire strut 30 is suspended from the wing at a point 33 (see FIGS. 1 and 1A) that approximates the aerodynamic center of the wing, that is, the point at which the drag and lift forces exerted on the wing are substantially resolved and the net moment about the point 33 is substantially constant for all attack angles of the wing. Referring in particular to FIG. 3, the angle of attack of the wing may be varied by bending wire strut 30 to adjust the location of weight 14. As shown in phantom in FIG. 3, the strut 30 may be bent forwardly to decrease the angle of attack and locate the center of gravity of the sailplane in a forward position. Alternatively, the strut 30 may be bent rearwardly to increase the angle of attack. Thus, the sailplane of the present invention may be adjusted to fly in various wind conditions. For example, if high speed wind conditions are present, the weight 14 may be moved forwardly whereas in low speed wind speed conditions the weight 14 can be moved rearwardly.

Referring to FIG. 1, the way in which strut 30 is attached to the wing will now be described. The wire strut 30 includes a loop 32 on the end thereof that is positioned adjacent the upper surface 26 of the wing. At the end 31 of the loop 32 the wire strut bends sharply downwardly through an aperture 34 (see FIGS. 1 and 1A) in the wing. In order to firmly secure the loop 32 adjacent upper surface 26, a thin flexible material 36 having an adhesive on one side thereof is placed on the loop 32 and adhered to the upper surface 26. The material may comprise paper having an adhesive on one side and printed matter such as a trademark, a manufacturer's name or other information on the other side. The loop preferably is directed from aperture 34 toward the nose 18 to weigh the nose downwardly and has its weight balanced with respect to central plane 16.

The wing 12 is formed from a lightweight material such as a polymeric foam, preferably a polystyrene foam having a smooth exterior surface. The upper surface 26 of the wing has a large surface area in comparison to the total weight of the sailplane. In a preferred embodiment of the invention, the ratio of the area of the upper surface of the total weight is between approximately 35 and 45 square centimeters per gram and most preferably between approximately 41 and 43 square centimeters per gram. To provide for adjustment of the center of gravity of the sailplane, the weight of the object 14 is preferably a substantial percentage of the total weight of the sailplane and most preferably comprises between about 40 and about 80 percent of the total weight of the sailplane.

The sailplane in accordance with the present invention has excellent lateral stability without the use of a conventional central vertical stabilizer. The use of a central vertical stabilizer is avoided by providing upwardly directed wing tip portions 22 that are symmetrical to and spaced outwardly from the central plane 16 of the wing 12. Wing tip portions 22 provide drag that is balanced with respect to the central plane of the wing and the wing, during flight, continually adjusts its lateral direction to equalize the drag forces on the wing tip portions. Thus, should a disequilibrium in drag forces exist, such as when the sailplane encounters a cross wind, a larger drag force on one of the wing tip portions will rotate the wing until the drag forces on the wing tip portions are equalized. Thus, the sailplane has a tendency to turn into the wind. Moreover, when a sailplane in accordance with the present invention has a tail wind, the sailplane will tend to glide smoothly forwardly in the direction of the tail wind because the drag forces on the wing tips will be at equilibrium. The central area of the wing, that is, the portion of the wing having convex mean chords 27 as shown in FIGS. 1A, 1B and 1C, provides the desired amount of lift to enable the sailplane to soar when it encounters an upward draft or an upward convection current, while the tip portions provide drag and lateral stability. The flight of a sailplane in accordance with the present invention is characterized by intermittent periods of gliding from a high point to a lower point and periods of soaring.

It should be understood that although a specific embodiment of the invention has been described herein in detail, such description is for purposes of illustration only and modifications may be made thereto by those skilled in the art within the scope of the invention.

What is claimed is:

1. A toy sailplane comprising:

a single piece sweptback wing being substantially symmetrical about a central plane and having a central nose, said wing having two leading edges extending in an angular relation with respect to each other from said central nose and having a tip portion located at the respective end of each said leading edge, said wing including a trailing edge extending between said tip portions, said wing including generally continuous smooth upper and lower surfaces extending between each said leading edge and said trailing edge, said upper surface being convex in cross-sections parallel to said central plane, said lower surface being concave in cross-sections parallel to said central plane with mean chords of the wing taken at cross-sections parallel to and progressing outwardly from said central plane having average slopes that gradually increase to define upwardly directed wing tip portions, said upper surface further being concave and said lower surface further being convex in respective cross-sections generally parallel to said leading edges in the regions of said tip portions, and means for weighting said wing suspended from the wing and located on said central plane.

2. A toy sailplane according to claim 1 wherein said chords each have a convex shape having no more than one inflection point.

3. A toy sailplane according to claim 2 wherein said chords as they progress outwardly gradually change from chords having inflection points that define a central wing area having downwardly directed leading and trailing edges to provide lift in said central wing area to chords having only a positive slope to provide an upwardly directed trailing edge in the region of said tip portions.

4. A toy sailplane according to claim 1 or 3 wherein said wing has a substantially uniform thickness and wherein said upper surface adjacent said leading and trailing edges tapers smoothly downwardly to said lower surface.

5. A toy sailplane according to claim 4 wherein for each said wing tip portion, said trailing edge curves smoothly rearwardly and inwardly from said leading edge.

6. A toy sailplane according to claim 5 wherein said trailing edge in the region between each said wing tip portion and said central plane is directed inwardly and forwardly toward said central plane and includes a segment curving smoothly and concavely in the region of said central plane.

7. A toy sailplane according to claim 1 or 3 and further including means for longitudinally adjusting the position of said weighting means to thereby vary the center of gravity of said sailplane and the angle of attack of said wing.

8. A toy sailplane according to claim 1 or 3 wherein said weighting means comprises an elongate bendable strut extending downwardly from substantially the aerodynamic center of the wing, and a weight attached to the lower end of said strut.

9. A toy sailplane according to claim 8 wherein said elongate strut comprises a bendable wire having a loop at the upper end thereof, said loop being secured adjacent the upper surface of the wing, said wire, at an end of the loop, extending downwardly through an aperture in the wing located at the aerodynamic center of the wing.

10. A toy sailplane according to claim 8 wherein said upper surface has an area and wherein said sailplane has a total weight, and wherein the ratio of the upper surface area and the total weight is between about 35 and about 45 square centimeters per gram.

11. A toy sailplane according to claim 10 wherein said weight attached to the end of said strut comprises between about 40 and about 80 percent of the total weight of the sailplane.

12. A toy sailplane according to claim 1 or 3 wherein said wing comprises polymeric foam.

13. A toy sailplane according to claim 12 wherein said wing comprises polystyrene foam.

14. A toy sailplane according to claim 1 or 3 wherein said angle is between about 80 and about 165 degrees.

15. A toy sailplane according to claim 14 wherein said angle is between about 90 and about 120 degrees.

16. A toy sailplane comprising:

a single piece sweptback wing being substantially symmetrical about a central plane, having a central nose and having two leading edges extending in an angular relation from said central nose, said wing having a tip portion located at each end of said leading edges, said wing including a trailing edge extending between said tip portions, said wing including generally continuous smooth upper and lower surfaces extending between each said leading edge and said trailing edge, said upper surface being convex in cross-sections parallel to said central plane, said lower surface being concave in cross-sections parallel to said central plane, with mean chords of the wing taken at cross-sections parallel to and progressing outwardly from said central plane having average slopes that gradually increase wherein said wing tip portions are directed upwardly, said upper surface further being concave and said lower surface further being convex in respective cross-sections generally parallel to said leading edges in the region of said tip portions, all to provide drag that is laterally balanced with respect to said central plane and to provide directional and lateral stability for said wing, said wing further including a central area intermediate said wing tip portions providing the lift; and weight means including an elongate strut having one end thereof attached to said wing at approximately the aerodynamic center of the wing and having a weight on the other end thereof.

17. A toy sailplane according to claim 16 wherein mean chords of the wing taken at cross-sections parallel to and progressing outwardly from said central plane have average slopes that gradually increase to define upwardly directed wing tip portions.

18. A toy sailplane according to claim 17 wherein said chords each have a convex shape having no more than one inflection point.

19. A toy sailplane according to claim 18 wherein said chords as they progress outwardly gradually change from chords having inflection points that define a central wing area having downwardly directed leading and trailing edges to provide lift in said central wing area to chords having only a positive slope to provide an upwardly directed trailing edge in the region of said tip portions.

20. A toy sailplane according to claim 19 wherein said wing has a substantially uniform thickness and wherein said upper surface adjacent said leading and trailing edges tapers smoothly downwardly to said lower surface.

21. A toy sailplane according to claim 20 wherein for each said wing tip portion, said trailing edge curves smoothly rearwardly and inwardly from said leading edge.

22. A toy sailplane according to claim 16 wherein said strut is bendable for longitudinally adjusting the position of said weight means to thereby vary the center of gravity of said sailplane and the angle of attack of said wing.

23. A toy sailplane according to claim 16 wherein said upper surface has an area and wherein said sailplane has a total weight, and wherein the ratio of the upper surface area and the total weight is between about 35 and about 45 square centimeters per gram.

24. A toy sailplane according to claim 16 wherein said wing comprises polymeric foam.

25. A toy sailplane according to claim 16 wherein said angle is between about 80 and about 165 degrees.

* * * * *

UNITED STATES PATENT AND TRADEMARK OFFICE

CERTIFICATE OF CORRECTION

PATENT NO. : 4,388,777

DATED : June 21, 1983

INVENTOR(S) : CARL Z. HERMANN ET AL.

It is certified that error appears in the above-identified patent and that said Letters Patent is hereby corrected as shown below:

Column 2

Line 33, change "is" to --in--.

Signed and Sealed this

*Twenty-first* Day of *August 1984*

[SEAL]

*Attest:*

GERALD J. MOSSINGHOFF

*Attesting Officer*

*Commissioner of Patents and Trademarks*